US009677299B2

(12) United States Patent
Whiteley

(10) Patent No.: US 9,677,299 B2
(45) Date of Patent: Jun. 13, 2017

(54) FENCING BASE WITH BALLAST WEIGHT

(71) Applicant: Oxford Plastic Systems Limited, Oxfordshire (GB)

(72) Inventor: Christopher James Whiteley, Buckinghamshire (GB)

(73) Assignee: Oxford Plastic Systems Limited, Oxfordshire (GB)

( * ) Notice: Subject to any disclaimer, the term of this patent is extended or adjusted under 35 U.S.C. 154(b) by 335 days.

(21) Appl. No.: 13/974,925

(22) Filed: Aug. 23, 2013

(65) Prior Publication Data

US 2014/0054529 A1 Feb. 27, 2014

(30) Foreign Application Priority Data

Aug. 24, 2012 (GB) ..... 1215134.6
Jan. 29, 2013 (GB) ..... 1301562.3

(51) Int. Cl.

| | |
|---|---|
| ***E04H 17/22*** | (2006.01) |
| ***E04H 17/16*** | (2006.01) |
| ***E04H 12/22*** | (2006.01) |
| ***E04H 17/18*** | (2006.01) |
| ***E04G 21/32*** | (2006.01) |
| ***E01F 9/692*** | (2016.01) |

(52) U.S. Cl.

CPC ..... *E04H 17/22* (2013.01); *E01F 9/692* (2016.02); *E04G 21/3238* (2013.01); *E04H 12/2246* (2013.01); *E04H 17/16* (2013.01); *E04H 17/18* (2013.01); *Y10T 29/49826* (2015.01)

(58) Field of Classification Search

CPC ..... E04H 17/16; E04H 17/18; E04H 17/22; E04H 17/08; E04H 12/2246; E04H 12/2238; E04H 12/22; E04G 21/3238; E01F 9/03; E01F 13/02; E01F 9/0124

See application file for complete search history.

(56) References Cited

U.S. PATENT DOCUMENTS 7,093,322 B2 * 8/2006 Townend ..... E04G 21/3233 16/400
2008/0224016 A1 * 9/2008 Defu ..... E04H 12/2246 248/523

FOREIGN PATENT DOCUMENTS

EP 0809227 A1 * 11/1997 ..... E01F 9/0124
EP 2525018 A1 * 11/2012 ..... E04F 11/1812
EP 2525019 A1 * 11/2012 ..... E04F 11/1812
GB 2458312 A * 9/2009 ..... E04H 12/2215

* cited by examiner

*Primary Examiner* — Matthieu F Setliff
(74) *Attorney, Agent, or Firm* — O'Shea Getz P.C.

(57) ABSTRACT

A ballast weight is provided for a base for supporting tubular fencing poles on spigots. The ballast weight is in the form of a removable slab of molded plastics which in its underside has groove portions to receive frame members of the base. The end of the slab lies over a central transverse member of the frame and has a recess to accommodate the spigots. A pair of identical slabs can be used, one each side of the central transverse member of the frame.

8 Claims, 5 Drawing Sheets

FENCING BASE WITH BALLAST WEIGHT

The present application claims priority to U.K. Patent Appln. No. 1215134.6 filed Aug. 24, 2012 and U.K. Patent Appln. No. 1301562.3 filed Jan. 29, 2013.

BACKGROUND OF THE INVENTION

1. Technical Field

This invention relates in general to a fencing base for supporting the poles of fencing and similar barriers used to delineate construction sites or the like. More particularly the invention relates to a combination of such a base and a ballast weight for placing over the base.

2. Background Information

There is known a base for fencing poles in the form of a rectangular frame comprising first and second spaced parallel longitudinally extending members, a first transverse member interconnecting the longitudinally extending members at one end of the frame, a second transverse member interconnecting the longitudinally extending members midway along the frame, two upwardly projecting spigots on the second transverse member, between the ends of the second transverse member, and a third transverse member interconnecting the longitudinally extending members at the other end of the frame. The longitudinally extending members and the transverse members may be tubes or rods of metal. The spigots may be of metal. In use the frame is placed on the ground with the spigots projecting upwardly, and a hollow tubular fence post of a fencing panel is placed over a spigot. If a hollow tubular fence post of a fencing panel is placed over both spigots, then the base serves as a junction between the two fencing panels. Typically, the fencing posts are in the form of metal tubes and the fencing panels are of metal.

Such a frame effectively provides two "U" shaped portions which are joined together at the ends of the legs of the "U". The first transverse member forms the base of one "U" shaped portion and the third transverse member forms the base of the other "U" shaped portion. The second transverse member extends across the ends of the legs of both "U" shaped portions.

It is also known to have a frame which comprises a single "U" shaped member, with the first transverse member fanning the base of the "U" shaped member and the second transverse member extending across the ends of legs of the "U" shaped member and carrying the spigots.

Typically the frame is constructed of longitudinal and transverse members which are joined together at right angles. Thus, the frame will be rectangular and where two "U" shaped portions are defined, the frame will comprise two rectangles.

To prevent unwanted displacement of the base and to resist a fencing panel being knocked or blown over, typically a weight such as a sand bag is placed over the frame. If the frame comprises two "U" shaped portions joined together, in some cases a weight such as a sand bag is placed only over one end of the frame, and in other cases a second weight such as a sand bag is placed over the other end of the frame.

Weights such as sand bags are cumbersome to store and transport, and unsightly. They can also provide a trip hazard for pedestrians, and there is no control over where on the base they might be positioned.

SUMMARY OF THE INVENTION

In accordance with some embodiments of the invention, there is provided a weight of dense plastic material which can be used with such a base for fencing poles.

Viewed from one aspect of the invention there is provided, in combination: (i) a base for fencing poles, the base being in the form of a frame comprising first and second longitudinal members interconnected by a first transverse member adjacent first ends of the longitudinal members, there being a second transverse member which interconnects the longitudinal members at a position spaced longitudinally from the first transverse member, and there being two upwardly projecting spigots on the second transverse member, between the ends of the second transverse member; and (ii) a removable ballast weight of molded plastics material in the form of a slab having an upper surface and a lower surface, the slab having a first end and a second end, the lower surface of the slab being provided with a groove having a first groove portion which extends longitudinally and receives a part of the first longitudinal member of the frame which extends from the first end of the first longitudinal member to adjacent the connection between the first longitudinal member and the second transverse member; a second groove portion which extends longitudinally and receives a part of the second longitudinal member of the frame which extends from the first end of the second longitudinal member to adjacent the connection between the second longitudinal member and the second transverse member; and a third groove portion which extends transversely and interconnects the first and second groove portions, the third groove portion receiving the first transverse member of the frame; wherein the first end of the slab extends over the first ends of the first and second longitudinal members of the frame and the over the first transverse member of the frame, and the second end of the slab is adjacent the second transverse member of the frame.

The second end of the slab may extend partially over the second transverse member of the frame. In such an arrangement, the second end of the slab may be provided with a recessed portion to accommodate the upwardly extending spigots of the frame.

The slab may be low profile, having a thickness between its upper and lower surfaces of no more than about six inches, preferably no more than about five inches, preferably no more than about four inches and most preferably no more than about three inches. In one embodiment the thickness of the slab is less than three inches and, for example, about 2.75 inches.

Preferably, at least the major part of the upper surface of the slab is flat, although there may be provided markings embossed on the slab. At least outer side portions of the slab may be provided with a high visibility color, such as yellow, to bring the attention of the slab to pedestrians. The outside of the first end of the slab may also be provided with such a high visibility color.

The outer side portions of the slab and the outside of the first end portion of the slab may be chamfered, to reduce the risk of a pedestrian tripping over the slab.

The slab may include an aperture extending between the upper and lower surfaces, to assist in lifting and manipulation.

In one embodiment, the groove in the slab has at least one portion which has a covered lower part, which assists in preventing dislodgement of the slab from the frame. In such an arrangement the slab can be slid into position so that portions of the frame are received in the groove. By having only part of the groove covered, it is possible to place the slab on the frame and slide it relative to the frame so that the required portions of the frame are received in the groove. In one arrangement, the covered part is adjacent the outer, first end of the slab. In one arrangement, there are provided two covered parts, respectively adjacent the join between the first groove portion and the third groove portion, and adjacent the join between the second groove portion and the third groove portion Where part of the groove is covered, a cover plate may be secured to the lower surface of the slab.

In some embodiments of the invention, the first longitudinal member of the frame extends beyond the second transverse member of the frame to a second end of the first longitudinal member; the second longitudinal member of the frame extends beyond the second transverse member of the frame to a second end of the second longitudinal member; and a third transverse member interconnects the first and second longitudinal members adjacent the second ends of the longitudinal members. In a preferred arrangement of such an embodiment, the distance between the first and second transverse members of the frame is substantially equal to the distance between the second and third transverse member of the frame.

In such arrangement, a second ballast weight may optionally be used, and thus the combination in accordance with the invention may further include a second removable ballast weight of molded plastics material in the form of a second slab having an upper surface and a lower surface, the second slab having a first end and a second end, the lower surface of the second slab being provided with a groove having a first groove portion which extends longitudinally and receives a part of the first longitudinal member of the frame which extends from the second end of the first longitudinal member to adjacent the connection between the first longitudinal member and the second transverse member; a second groove portion which extends longitudinally and receives a part of the second longitudinal member of the frame which extends from the second end of the second longitudinal member to adjacent the connection between the second longitudinal member and the second transverse member; and a third groove portion which extends transversely and interconnects the first and second groove portions, the third groove portion receiving the third transverse member of the frame; wherein the first end of the second slab extends over the second ends of the first and second longitudinal members of the frame and the over the third transverse member of the frame, and the second end of the second slab is adjacent the second transverse member of the frame.

The second end of the second slab may extend partially over the second transverse member of the frame. In such an arrangement, the second end of the second slab may be provided with a recessed portion to accommodate the upwardly extending spigots of the frame.

The second slab may be low profile, having a thickness between its upper and lower surfaces of no more than about six inches, preferably no more than about five inches, preferably no more than about four inches and most preferably no more than about three inches. In one embodiment the thickness of the second slab is less than three inches and, for example, about 2.75 inches.

Preferably, at least the major part of the upper surface of the second slab is flat, although there may be provided markings embossed on the slab. At least outer side portions of the second slab may be provided with a high visibility color, such as yellow, to bring the attention of the second slab to pedestrians. The outside of the first end of the second slab may also be provided with such a high visibility color.

The outer side portions of the second slab and the outside of the first end portion of the second slab may be chamfered, to reduce the risk of a pedestrian tripping over the second slab.

The second slab may include an aperture extending between the upper and lower surfaces, to assist in lifting and manipulation.

In one embodiment, the groove in the second slab has at least one portion which has a covered lower part, which assists in preventing dislodgement of the second slab from the frame. In such an arrangement the second slab can be slid into position so that portions of the frame are received in the groove. By having only part of the groove covered, it is possible to place the second slab on the frame and slide it relative to the frame so that the required portions of the frame are received in the groove. In one arrangement, the covered part is adjacent the outer, first end of the second slab. In one arrangement, there are provided two covered parts, respectively adjacent the join between the first groove portion and the third groove portion, and adjacent the join between the second groove portion and the third groove portion Where part of the groove is covered, a cover plate may be secured to the lower surface of the second slab.

In a preferred arrangement the first and second slabs are identical.

Where two slabs are used, their inner ends may abut or be closely adjacent.

Where first and second slabs are used, they may be connected together by at least one security element, for example of molded plastics material. This may comprise an elongate element with a downwardly projecting lug at each end. There may be provided a security aperture in the upper surface of the first slab, adjacent the second end of the first slab, and a security aperture in the upper surface of the second slab, adjacent the second end of the second slab, opposite the security aperture in the first slab. One lug of the security element will be received in the security aperture in the first slab and the other lug of the security element will be received in the security aperture in the second slab. The lugs may form press fits in the security apertures, and be resistant to removal. There may be a plurality of security elements with respective security apertures. For example, there could be one security element adjacent one side of the first and second slabs, and another security element adjacent the other side of the first and second slabs.

Where a single a slab or a pair of slabs are used, as described above, one or both slabs may be supplemented by one or more like slabs placed on top, or by other ballast, in the event of particularly heavy winds, for example.

The invention also extends to a combination as described above of the frame and one or two slabs, together with a fencing panel having a tubular fencing pole which engages with a spigot on the second transverse member. The invention also extends to a combination as described above of the frame and one or two slabs, together with a first fencing panel having a first tubular fencing pole which engages with a first of the spigots on the second transverse member, and a second fencing panel having a second tubular fencing pole which engages with the second of the spigots on the second transverse member.

Preferably a slab used in embodiments of the invention, which is preferably of recycled plastics, has a weight of at least about 10 Kilos, or at least about 15 kilos, or at least about 16.5 kilos; for example being in the range of from about between about 10 to about 20 kilos, for example between about 15 to about 20 kilos, for example typically being about 16.5 kilos. Alternatively the weight may be at least about 20 to 22 pounds or at least about 30 to 33 pounds, or at least about 35 to 40 pounds; for example being in the range of from about between about 20 to about 44 pounds, for example between about 33 to about 44 pounds, for example typically being about 36 to 37 pounds.

A slab used in embodiments of the invention may be of substantially rectangular profile, for example having a width of between about 20 inches and about 25 inches, and a depth of between about 20 inches and about 25 inches. The corners at the first end of the slab may be rounded.

The invention also provides a method of applying ballast to a base for fencing poles, the base being in the form of a frame comprising first and second longitudinal members interconnected by a first transverse member adjacent first ends of the longitudinal members, there being a second transverse member which interconnects the longitudinal members at a position spaced longitudinally from the first transverse member, and there being two upwardly projecting spigots on the second transverse member, between the ends of the second transverse member; the method comprising applying to the frame a removable ballast weight of molded plastics material in the form of a slab having an upper surface and a lower surface, the slab having a first end and a second end, the lower surface of the slab being provided with a groove having a first groove portion which extends longitudinally and receives a part of the first longitudinal member of the frame which extends from the first end of the first longitudinal member to adjacent the connection between the first longitudinal member and the second transverse member; a second groove portion which extends longitudinally and receives a part of the second longitudinal member of the frame which extends from the first end of the second longitudinal member to adjacent the connection between the second longitudinal member and the second transverse member; and a third groove portion which extends transversely and interconnects the first and second groove portions, the third groove portion receiving the first transverse member of the frame; wherein the first end of the slab extends over the first ends of the first and second longitudinal members of the frame and the over the first transverse member of the frame, and the second end of the slab is adjacent the second transverse member of the frame.

In some embodiments, the first longitudinal member of the frame extends beyond the second transverse member of the frame to a second end of the first longitudinal member; the second longitudinal member of the frame extends beyond the second transverse member of the frame to a second end of the second longitudinal member; and a third transverse member interconnects the first and second longitudinal members adjacent the second ends of the longitudinal members; and the method further comprises applying to the frame a second removable ballast weight of molded plastics material in the form of a second slab having an upper surface and a lower surface, the second slab having a first end and a second end, the lower surface of the second slab being provided with a groove having a first groove portion which extends longitudinally and receives a part of the first longitudinal member of the frame which extends from the second end of the first longitudinal member to adjacent the connection between the first longitudinal member and the second transverse member; a second groove portion which extends longitudinally and receives a part of the second longitudinal member of the frame which extends from the second end of the second longitudinal member to adjacent the connection between the second longitudinal member and the second transverse member; and a third groove portion which extends transversely and interconnects the first and second groove portions, the third groove portion receiving the third transverse member of the frame; wherein the first end of the second slab extends over the second ends of the first and second longitudinal members of the frame and the over the third transverse member of the frame, and the second end of the second slab is adjacent the second transverse member of the frame.

In all embodiments of the invention an advantage is that the slab presents a low profile, being relatively shallow, to reduce the risk of tripping. The weight is also sturdier than for example a sandbag.

The invention also extends to a combined base and weight, in which the plastics weight is molded around the metal frame at the manufacturing stage rather than being removable and being molded first and then placed over the metal frame.

Thus, viewed from another aspect, there is provided a combined base and ballast weight for fencing poles, wherein: (i) the base is in the form of a frame comprising first and second longitudinal members interconnected by a first transverse member adjacent first ends of the longitudinal members, there being a second transverse member which interconnects the longitudinal members at a position spaced longitudinally from the first transverse member, and there being two upwardly projecting spigots on the second transverse member, between the ends of the second transverse member; and (ii) the ballast weight comprises a slab of plastics material which has been molded around the frame, the slab having an upper surface and a lower surface, the slab having a first end and a second end, the lower surface of the slab being provided with a groove having a first groove portion which extends longitudinally and receives a part of the first longitudinal member of the frame which extends from the first end of the first longitudinal member to adjacent the connection between the first longitudinal member and the second transverse member; a second groove portion which extends longitudinally and receives a part of the second longitudinal member of the frame which extends from the first end of the second longitudinal member to adjacent the connection between the second longitudinal member and the second transverse member; and a third groove portion which extends transversely and interconnects the first and second groove portions, the third groove portion receiving the first transverse member of the frame; wherein the first end of the slab extends over the first ends of the first and second longitudinal members of the frame and the over the first transverse member of the frame, and the second end of the slab is adjacent the second transverse member of the frame.

In some embodiments of this aspect of the invention the first longitudinal member of the frame extends beyond the second transverse member of the frame to a second end of the first longitudinal member; the second longitudinal member of the frame extends beyond the second transverse member of the frame to a second end of the second longitudinal member; and a third transverse member interconnects the first and second longitudinal members adjacent the second ends of the longitudinal members; and there is further provided a second slab of plastics material which has been molded around the frame, the second slab having an upper surface and a lower surface, the second slab having a first end and a second end, the lower surface of the second slab being provided with a groove having a first groove portion which extends longitudinally and receives a part of the first longitudinal member of the frame which extends from the second end of the first longitudinal member to adjacent the connection between the first longitudinal member and the second transverse member; a second groove portion which extends longitudinally and receives a part of the second longitudinal member of the frame which extends from the second end of the second longitudinal member to adjacent the connection between the second longitudinal member and the second transverse member; and a third groove portion which extends transversely and interconnects the first and second groove portions, the third groove portion receiving the third transverse member of the frame; wherein the first end of the second slab extends over the second ends of the first and second longitudinal members of the frame and the over the third transverse member of the frame, and the second end of the second slab is adjacent the second transverse member of the frame. The first and second slabs may be integrally molded to form one large slab around the frame.

BRIEF DESCRIPTION OF THE DRAWINGS

The invention will be better understood by reference to the following description of preferred embodiments, in conjunction with the accompanying drawings, in which.

DETAILED DESCRIPTION OF THE INVENTION

Figure 1:
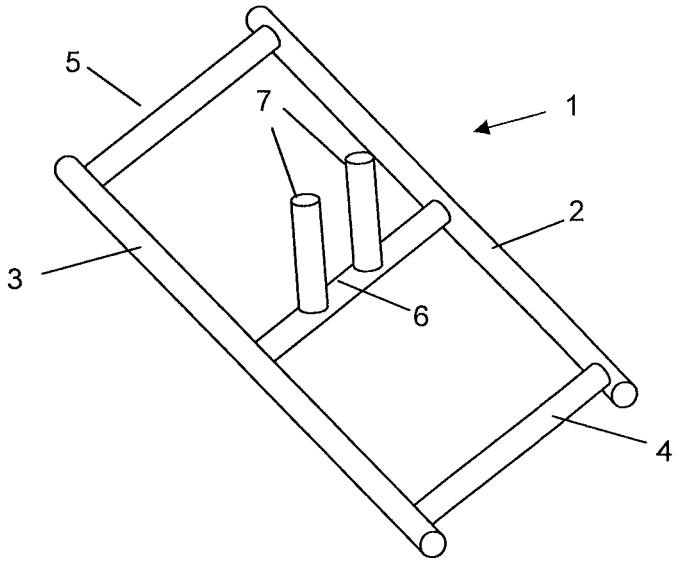
FIG. 1 is a perspective view of a base for supporting fencing posts.

Referring now to FIG. 1, there is shown a support 1 for supporting tubular metal fencing posts. The support 1 is constructed from solid metal, e.g. steel rods welded together. The support is in the form of a rectangular frame and has a first longitudinal member 2, a second longitudinal member 3 which is spaced from and parallel to the first longitudinal member, a first transverse member 4 joining together the longitudinal members 2 and 3 at one end, and a second transverse member 5 joining together the longitudinal members 2 and 3 at the other end. Mid-way along the longitudinal members, they are joined together by a third, central, transverse member 6. This carries two steel spigots 7 projecting upwardly, which can receive tubular fencing posts of fence panels.

Figure 2:
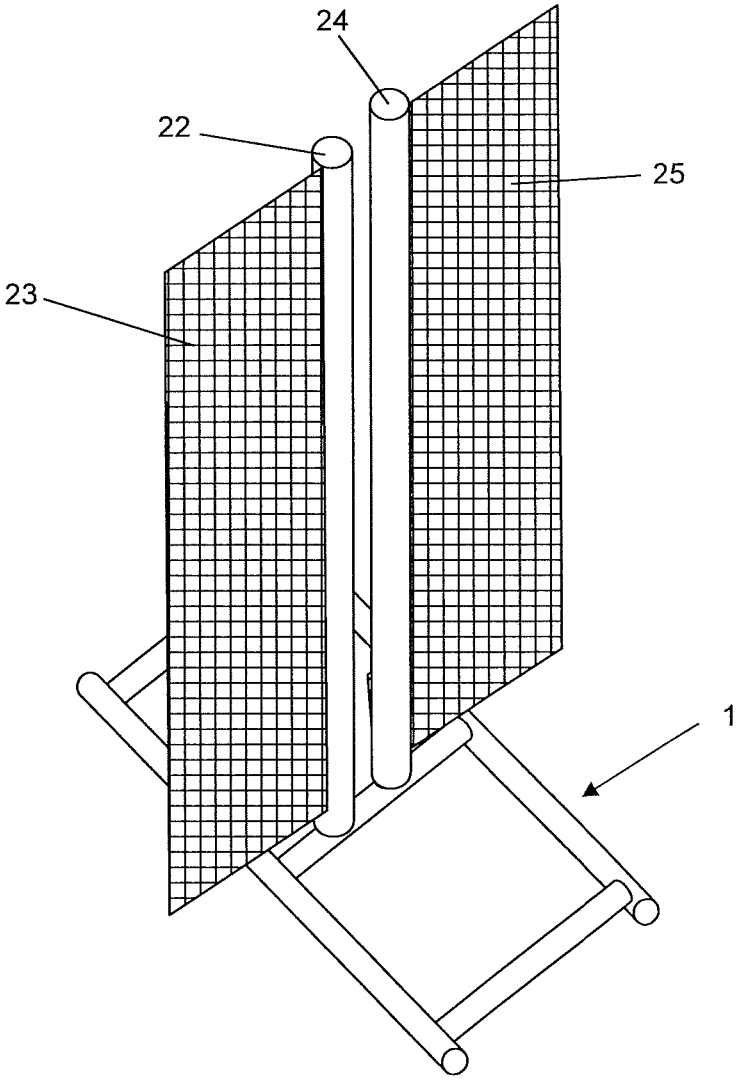
FIG. 2 is a perspective view of the base with two fencing panels attached.

FIG. 2 shows the base 1 in use. One spigot receives the end of a tubular metal fence post 22 of a first metal fencing panel 2, and the other spigot receives the end of a tubular metal fence post 24 of a second metal fencing panel 25.

Figure 3:
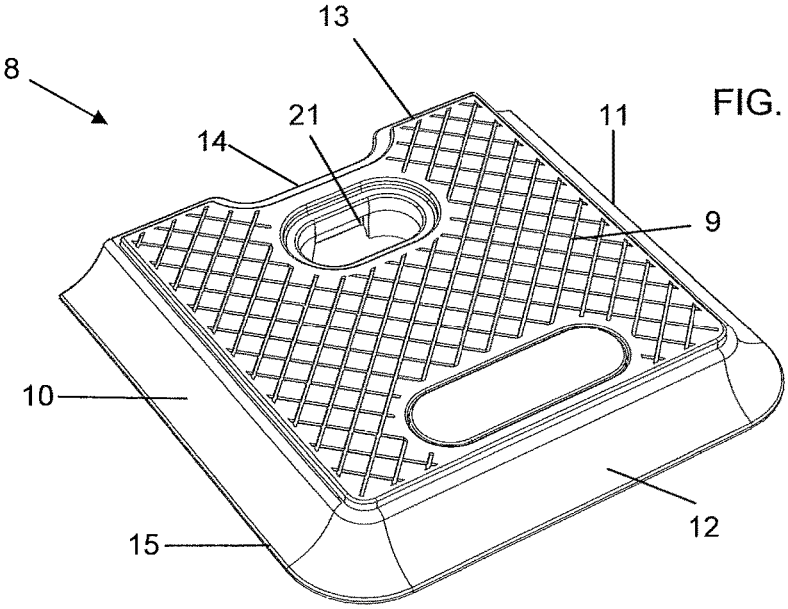
FIG. 3 is a top perspective view of a weight for use with the base.
Figure 4:
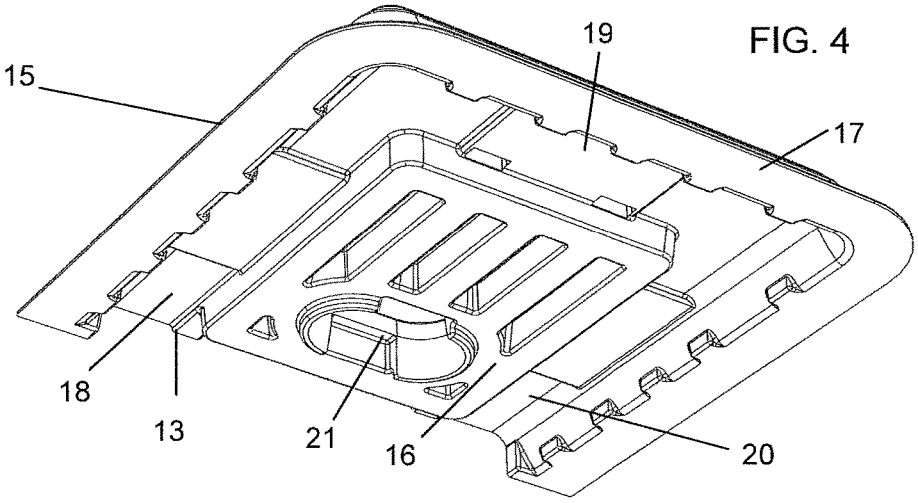
FIG. 4 is an underneath perspective view of the weight.
Figure 5:
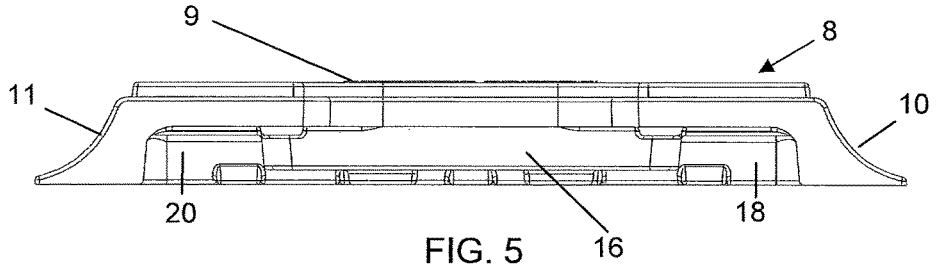
FIG. 5 is a view of the weight from one end.

FIGS. 3, 4 and 5 show a weight 8 for use as ballast in holding the support on a surface. The weight is in the form of a slab of molded recycled PVC, and has a top surface 9, a first side 10, a second side 11, a close end 12 and an open end 13. The open end 13 is provided with a recess 14. The slab has a base 15, and as shown in FIG. 3, this is divided into a peripheral region 16 along the side 10, the end 12 and the side 11, and a central region 17. There is defined an open bottomed grove between these regions of the base, which is of "U" shape having a first portion 18 extending longitudinally adjacent side 10 from an open end at end 13; a second transverse portion 19 extending adjacent end 12 of the slab; and a third portion 20 extending longitudinally adjacent side 11 to an open end at end 13 of the slab. The slab has been designed to accommodate one half of the support frame, the parts of members 2 and 3, and all of transverse member 4, in the groove defined by portions 18, 19 and 20. There is also an opening 21 passing through the slab from the upper surface 9 through to the central region 17 of the base of the slab, to assist in picking up the slab.

Figure 6:
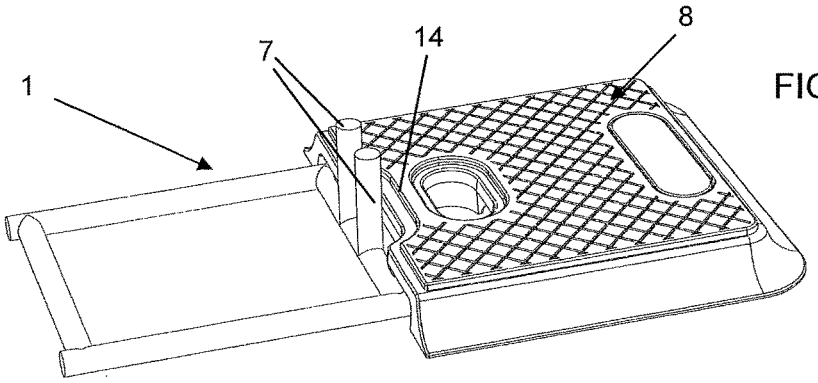
FIG. 6 is a perspective view of the weight in position on the base.
Figure 7:
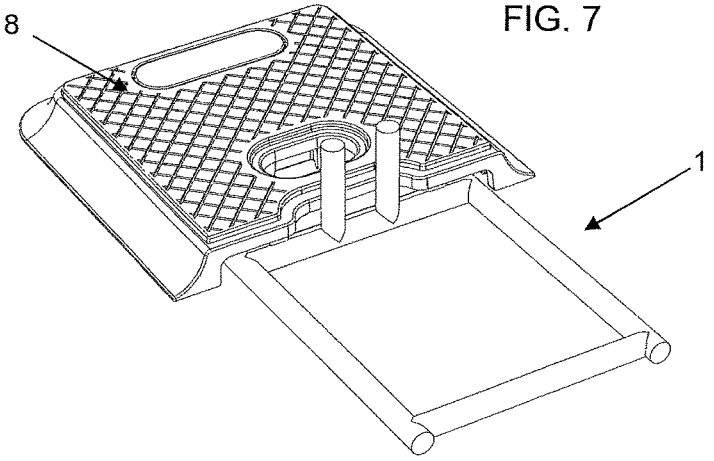
FIG. 7 is another perspective view of the weight on the base.
Figure 8:
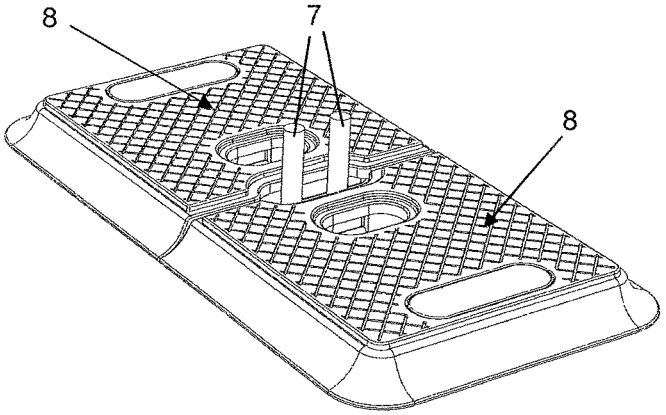
FIG. 8 is a perspective view of two of the weights on the base.

FIGS. 6 and 7 show the weight in position on the frame. The weight can be used in the single form as shown, or in the double form as shown in FIG. 8, in which two identical weights are used at opposite ends of the frame, and abut, or meet closely, in the middle. The two recesses 14 form an oval opening through which the spigots 7 protrude.

Figure 9:
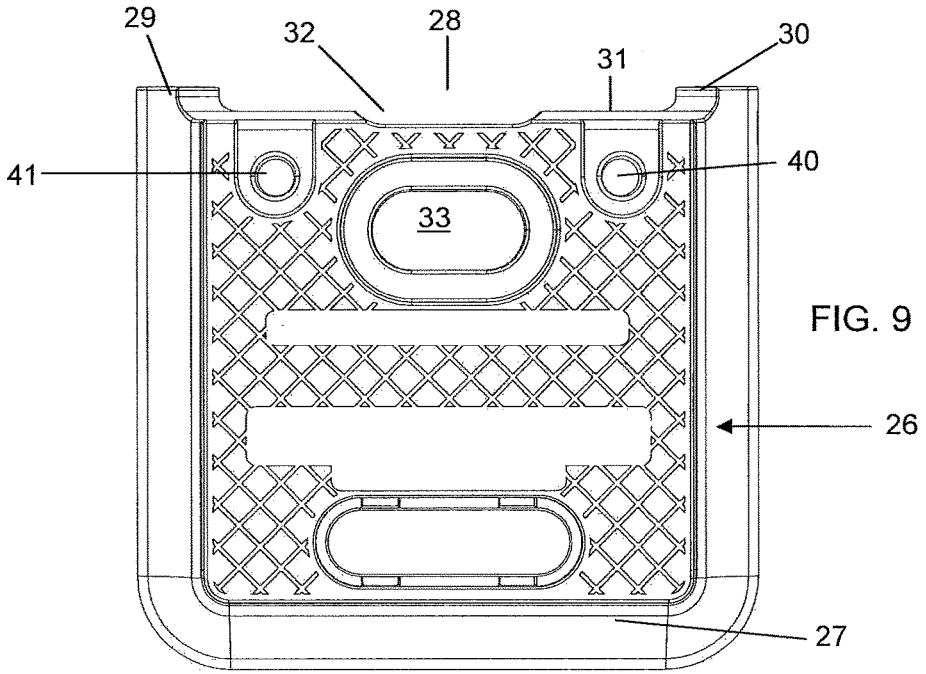
FIG. 9 is a top plan view of an alternative weight.

In FIG. 9, shows an alternative weight, also in the form of a slab 26. As with the weight of the previous embodiment, this has a closed end 27 and an open end 28. The configuration of the open end is changed somewhat and there are defined to lateral protrusions 29 and 30. Between these protrusions there is provided an extended recessed area 31. In a central region 32, there is an additional recess, corresponding to where the fence poles will be positioned. An aperture 33 is provided.

Figure 10:
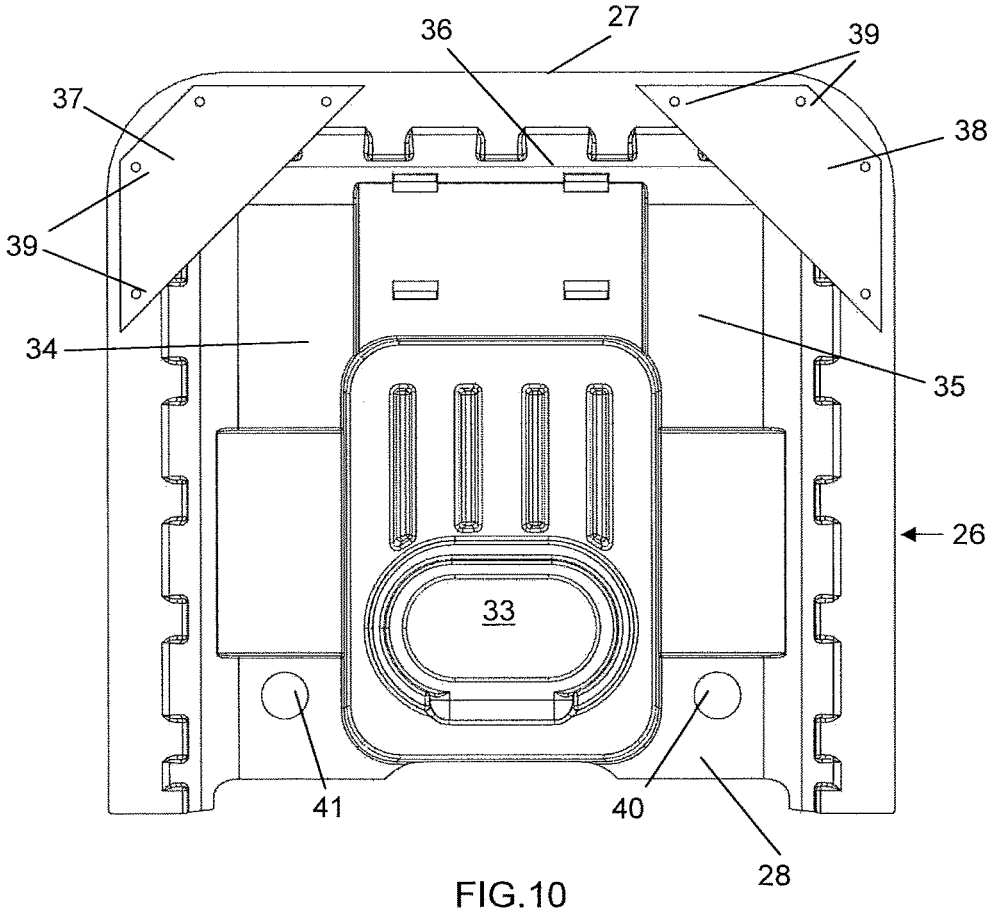
FIG. 10 is an underneath plan view of the weight of FIG. 9.
Figure 11:
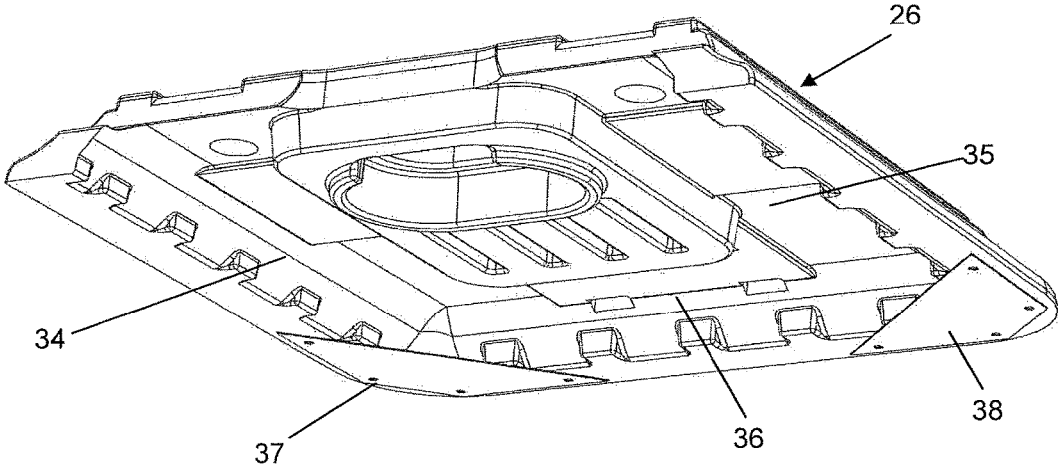
FIG. 11 is an underneath perspective view of the weight of FIG. 9.

FIGS. 10 and 11 show the underneath of this embodiment. There is an open "U" shaped groove defined by two longitudinal portions 34 and 35, interconnected by a transverse portion 36. At the two corners of the groove, i.e. adjacent the junctions between portions 34 and 36, and 35 and 36, the groove is covered. In this embodiment this is achieved by two cover plates 37 and 38 which are secured to the underside of the slab by fasteners 39 and extend across the respective corners. The cover plates are optional and can be omitted in a modification of this embodiment.

Figure 12:
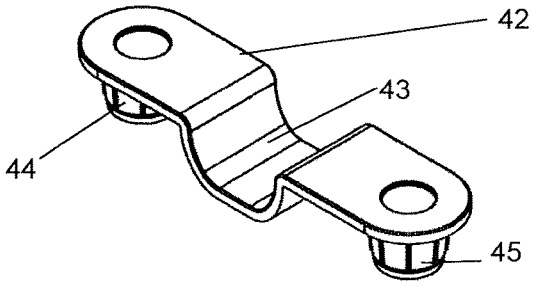
FIG. 12 is a perspective view of a security clamp that may be used to join together two weights.

The slab 26 is provided with a pair of apertures 40 and 41. When two slabs are used together, the aperture 40 of one slab is opposite the aperture 41 of the other slab, and the aperture 41 of said one slab is opposite the aperture 40 of the other slab. FIG. 12 shows an elongate molded plastics security clamp 42 that is used to join the slabs together using the apertures. The clamp has a curved central portion 43, that permits bending, and a lug 44, 45 at each end that forms a fit inside a respective aperture 40, 41.

Although this invention has been shown and described with respect to the detailed embodiments thereof, it will be understood by those skilled in the art that various changes in form and detail may be made without departing from the spirit and scope of the invention.

What is claimed is:

1. A fencing apparatus, comprising:

(i) a base for a fencing pole of a fencing system including a fencing panel having a tubular fencing pole, the base being in the form of a frame including first and second parallel longitudinal members extending longitudinally from adjacent a first end of the base remote from the fencing pole to a second end of the base adjacent the fencing pole;

the longitudinal members being interconnected by a first transverse member adjacent the first end of the base, there being a second transverse member which interconnects the longitudinal members adjacent the second end of the base;

and there being an upwardly projecting spigot on the second transverse member, between the ends of the second transverse member;

the tubular fencing pole engaging with the spigot; and (ii) a removable ballast weight of molded recycled plastics material in the foil of a flat slab having an upper surface and a lower surface and outer side portions, wherein at least outer side portions of the slab are provided with a high visibility colour, the slab having a first end and a second end, the lower surface of the slab being provided with a "U" shaped open bottomed groove having first and second open ends at the second end of the slab, the groove having:

a first groove portion extending longitudinally from the first open end of the groove, to adjacent the first end of the slab;

a second groove portion extending parallel to the first groove portion from the second open end of the groove at the second end of the slab, to adjacent the first end of the slab;

and a third groove portion extending transversely adjacent the first end of the slab, interconnecting the first groove portion and the second groove portion;

wherein, in use, the slab is placed on the frame with the second end of the slab spaced longitudinally from the first end of the frame, the first groove portion receiving part of the first longitudinal member of the frame with part of the first longitudinal member protruding from the first open end and the second groove portion receiving part of the second longitudinal member of the frame with part of the second longitudinal member protruding from the second open end, and the slab is then slid relative to the frame so that the first end of the slab is adjacent the first end of the frame, the second end of the slab is adjacent the second end of the frame, the third groove portion receives the first transverse member of the frame, and the second end of the slab is provided with a recessed portion to accommodate the upwardly extending spigot of the frame.

2. The apparatus of claim 1, wherein the slab includes an aperture extending between the upper and lower surfaces of the slab to assist in lifting and manipulation.

3. The apparatus of claim 1, wherein outer side portions of the slab and the outside of the first end of the slab are provided with a high visibility color to bring the attention of the slab to pedestrians.

4. A fencing apparatus, comprising:

(i) a base for a fencing pole of a fencing system including a fencing panel having a tubular fencing pole, the base being in the form of a frame including first and second parallel longitudinal members extending longitudinally from adjacent a first end of the base remote from the fencing pole on one side of the fencing panel to a second end of the base remote from the fencing pole on the other side of the fencing panel;

the longitudinal members being interconnected by a first transverse member adjacent the first end of the base, a second transverse member adjacent the second end of the base, and a third transverse member adjacent the fencing panel;

there being an upwardly projecting spigot on the third transverse member which engages with the tubular fencing pole; and (ii) a first removable ballast weight of molded recycled plastics material in the foul of a first flat slab having an upper surface and a lower surface and outer side portions, wherein at least outer side portions of the slab are provided with a high visibility colour, the first slab having a first end and a second end, the lower surface of the first slab being provided with a "U" shaped open bottomed groove having first and second open ends at the second end of the first slab, the groove having:

a first groove portion extending longitudinally from the first open end of the groove, to adjacent the first end of the first slab;

a second groove portion extending parallel to the first groove portion from the second open end of the groove at the second end of the first slab, to adjacent the first end of the first slab;

and a third groove portion extending transversely adjacent the first end of the first slab, interconnecting the first groove portion and the second groove portion;

wherein, in use, the first slab is placed on the frame on one side of the third transverse member of the frame with the second end of the first slab spaced longitudinally from third transverse member of the frame, the first groove portion receiving part of the first longitudinal member of the frame with part of the first longitudinal member protruding from the first open end and the second groove portion receiving part of the second longitudinal member of the frame with part of the second longitudinal member protruding from the second open end, and the first slab is then slid relative to the frame so that the first end of the first slab is adjacent the first end of the frame, the second end of the first slab is adjacent the third transverse member of the frame, the third groove portion receives the first transverse member of the frame, and the second end of the first slab is provided with a recessed portion to accommodate the upwardly extending spigot of the frame; and (iii) a second removable ballast weight of molded recycled plastics material in the form of a second flat slab having an upper surface and a lower surface and outer side portions, wherein at least outer side portions of the slab are provided with a high visibility colour, the second slab having a first end and a second end, the lower surface of the second slab being provided with a "U" shaped open bottomed groove having first and second open ends at the second end of the second slab, the groove having:

a first groove portion extending longitudinally from the first open end of the groove, to adjacent the first end of the second slab;

a second groove portion extending parallel to the first groove portion from the second open end of the groove at the second end of the second slab, to adjacent the first end of the second slab;

and a third groove portion extending transversely adjacent the first end of the second slab, interconnecting the first groove portion and the second groove portion;

wherein, in use, the second slab is placed on the frame on the other side of the third transverse member of the frame, with the second end of the second slab spaced longitudinally from the third transverse member of the frame, the first groove portion receiving part of the first longitudinal member of the frame with part of the first longitudinal member protruding from the first open end and the second groove portion receiving part of the second longitudinal member of the frame with part of the second longitudinal member protruding from the second open end, and the second slab is then slid relative to the frame so that the first end of the second slab is adjacent the second end of the frame, the second end of the second slab is adjacent the third transverse member of the frame, the third groove portion receives the second transverse member of the frame, and the second end of the second slab is provided with a recessed portion to accommodate the upwardly extending spigot of the frame.

5. The apparatus of claim 4, wherein each of the first and second slabs includes an aperture extending between the upper and lower surfaces of the slabs to assist in lifting and manipulation.

6. The apparatus of claim 4, wherein outer side portions of each of the first and second slabs and the outsides of the first ends of the first and second slabs are provided with a high visibility color to bring the attention of the slabs to pedestrians.

7. A method of stabilizing a fencing apparatus, in which the apparatus includes:

(i) a base for a fencing pole of a fencing system including a fencing panel having a tubular fencing pole, the base being in the form of a frame including first and second parallel longitudinal members extending longitudinally from adjacent a first end of the base remote from the fencing pole on one side of the fencing panel to a second end of the base remote from the fencing pole on the other side of the fencing panel;

the longitudinal members being interconnected by a first transverse member adjacent the first end of the base, a second transverse member adjacent the second end of the base, and a third transverse member adjacent the fencing panel;

there being an upwardly projecting spigot on the third transverse member which engages with the tubular fencing pole; and (ii) a first removable ballast weight of molded recycled plastics material in the form of a first flat slab having an upper surface and a lower surface and outer side portions, wherein at least outer side portions of the slab are provided with a high visibility colour, the first slab having a first end and a second end, the lower surface of the first slab being provided with a "U" shaped open bottomed groove having first and second open ends at the second end of the first slab, the groove having:

a first groove portion extending longitudinally from the first open end of the groove, to adjacent the first end of the first slab;

a second groove portion extending parallel to the first groove portion from the second open end of the groove at the second end of the first slab, to adjacent the first end of the first slab;

and a third groove portion extending transversely adjacent the first end of the first slab, interconnecting the first groove portion and the second groove portion;

the second end of the first slab being provided with a recessed portion;

wherein the method comprises:

placing the first slab on the frame on one side of the third transverse member of the frame with the second end of the first slab spaced longitudinally from the third transverse member of the frame, the first groove portion receiving part of the first longitudinal member of the frame with part of the first longitudinal member protruding from the first open end and the second groove portion receiving part of the second longitudinal member of the frame with part of the second longitudinal member protruding from the second open end; and sliding the first slab relative to the frame so that the first end of the first slab is adjacent the first end of the frame, the second end of the first slab is adjacent the third transverse member of the frame, the third groove portion receives the first transverse member of the frame, and the recessed portion in the second end of the first slab accommodates the upwardly extending spigot of the frame.

8. The method of claim 7, wherein the fencing apparatus includes:

(iii) a second removable ballast weight of molded recycled plastics material in the form of a second flat slab having an upper surface and a lower surface and outer side portions, wherein at least outer side portions of the slab are provided with a high visibility colour, the second slab having a first end and a second end, the lower surface of the second slab being provided with a "U" shaped open bottomed groove having first and second open ends at the second end of the second slab, the groove having: a first groove portion extending longitudinally from the first open end of the groove, to adjacent the first end of the second slab; a second groove portion extending parallel to the first groove portion from the second open end of the groove at the second end of the second slab, to adjacent the first end of the second slab; and a third groove portion extending transversely adjacent the first end of the second slab, interconnecting the first groove portion and the second groove portion; the second end of the second slab being provided with a recessed portion; and wherein the method further comprises:

placing the second slab on the frame on the other side of the third transverse member of the frame, with the second end of the second slab spaced longitudinally from the third transverse member of the frame with part of the first longitudinal member protruding from the first open end, the first groove portion receiving part of the first longitudinal member of the frame and the second groove portion receiving part of the second longitudinal member of the frame with part of the second longitudinal member protruding from the second open end, and sliding the second slab relative to the frame so that the first end of the second slab is adjacent the second end of the frame, the second end of the second slab is adjacent the third transverse member of the frame, the third groove portion receives the second transverse member of the frame, and the second end of the second slab is provided with a recessed portion to accommodate the upwardly extending spigot of the frame, and the recessed portion in the second end of the second slab accommodating the upwardly extending spigot of the frame.

* * * * *